United States Patent [19]

Carow

[11] Patent Number: 4,913,200

[45] Date of Patent: Apr. 3, 1990

[54] LIQUID DISPENSING NOZZLE WITH A PUMP PRESSURE RESPONSIVE AUTOMATIC SHUT-OFF MECHANISM

[75] Inventor: Walter M. Carow, Roane County, Tenn.

[73] Assignee: Richards Industries, Inc., Rockwood, Tenn.

[21] Appl. No.: 298,675

[22] Filed: Jan. 19, 1989

[51] Int. Cl.[4] ..... B65B 3/28

[52] U.S. Cl. ..... 141/217; 137/463; 141/225

[58] Field of Search ..... 222/14, 55, 59; 141/217, 218, 225, 227, 228, 392, 192, 198, 206–209; 137/463, 458, 459, 464

[56] References Cited

U.S. PATENT DOCUMENTS

| | | | |
|---|---|---|---|
| 3,005,476 | 10/1961 | Klaus | 141/217 X |
| 3,077,212 | 2/1963 | Hearn | 141/218 X |
| 4,331,187 | 5/1982 | Trygg | 141/217 X |
| 4,572,255 | 2/1986 | Rabinovich | 141/217 |

*Primary Examiner*—Kevin P. Shaver
*Attorney, Agent, or Firm*—Pitts and Brittian

[57] ABSTRACT

A liquid dispensing nozzle (10) with a pump pressure responsive automatic shut-off mechanism. The nozzle (10) comprises a body (12) with an internal passageway (13) therethrough defining an inlet port (14) for being connected to a dispensing pump and an outlet port (16). A main valve (18) is mounted in the body (12) for selectively opening and closing the passageway (13) to the flow of liquid, and a latch mechanism (29) is provided for selectively closing, and prohibiting the opening of, the main valve (18). The nozzle (10) further comprises automatic shut-off mechanism for releasing the latch mechanism so as to close, and prohibit the opening of, the main valve when supply pressure from the dispensing pump falls below a preselected value. Such automatic shut-off mechanism includes an actuator member ( b 43) operatively associated with the latch mechanism (29) and movably responsive to fluid pressure within the passageway between the inlet port (14) and the outlet port (16) reaching a preselected value.

8 Claims, 3 Drawing Sheets

LIQUID DISPENSING NOZZLE WITH A PUMP PRESSURE RESPONSIVE AUTOMATIC SHUT-OFF MECHANISM

DESCRIPTION

1. Technical Field

This invention relates to an improved liquid dispensing nozzle for dispensing a fuel or other liquid. In this particular invention, the nozzle includes a first automatic shut-off means for automatically closing the main valve of the nozzle when pressure from the dispensing pump falls below a preselected value.

2. Background Art

Fuel dispensing nozzles of the general type used on fuel pumps in filling stations have long been provided with hold-open catches for holding the operating lever in an open position and automatic shut-off means for shutting off the flow of fuel from the nozzle when the fuel level in the tank being filled reaches the discharge end of the nozzle. Whereas, such features allow the operator to leave the nozzle unattended during the filling operation without fear that the tank being filled will overflow, problems have arisen with the use of nozzles with hold-open catches and automatic shut-off mechanisms at pre-pay self-service filling stations. For example, at such stations, the dispensing pump is preset to dispense a preselected volume of fuel and automatically cease pumping. Where the dispensing nozzle used is provided with a hold-open catch, it is not uncommon for the operator of the nozzle to set the hold-open catch and leave the nozzle unattended until the pump stops dispensing fuel. However, with the hold-open catch in place, the operating lever can remain in an open position when fuel flow is terminated at the pump, and the nozzle can be returned to the pump with the main valve in an open position. Thus, when the dispensing pump is subsequently activated, fuel is allowed to flow from the nozzle before it is removed from the pump and before the operator has had an opportunity to place the nozzle in the desired dispensing position.

As a result of the problem noted above, many self-service filling stations have removed the hold-open catches from their nozzles. However, this denies their customers the convenience of being able to leave the nozzle unattended during the filling operation. Moreover, even in pre-pay filling stations where the hold-open catches have been removed, the danger of inadvertent dispensing of fuel still exists. For example, the nozzle operating lever can become blocked in an open position, accidentally held open on the dispensing pump locking mechanism or intentionally wired open. Thus, attempts have been made to devise automatic shut-off mechanisms which would prohibit the nozzle from dispensing in the absence of pumping pressure in excess of a preselected value. One such mechanism is disclosed in U.S. Pat. No. 4,572,255, and certain related prior art devices are disclosed in the patents cited therein.

Therefore, it is an object of the present invention to provide an improved liquid dispensing nozzle which automatically closes the main valve of the nozzle when dispensing pump pressure falls below a preselected value.

It is another object of the present invention to provide an improved liquid dispensing nozzle which cannot be reset to an open position until dispensing pump pressure reaches a preselected value and the operating lever of the nozzle is properly manipulated.

It is yet another object of the present invention to provide an improved liquid dispensing nozzle which carries a hold-open catch and an automatic shut-off means for closing the main valve of the nozzle when the fuel level of the tank being filled reaches the discharge end of the nozzle.

Still another object of the present invention is to provide an improved liquid dispensing nozzle which can be safely used at pre-pay self-service filling stations.

Another object of the present invention is to provide an improved liquid dispensing nozzle which is inexpensive to manufacture and inexpensive to maintain.

DISCLOSURE OF THE INVENTION

Other objects and advantages will be accomplished by the present invention which provides an improved liquid dispensing nozzle for dispensing a liquid such as fuel, from a dispensing pump. The improved nozzle of the present invention comprises a body provided with an internal passageway defining an inlet port for being releasably connected in fluid communication to the dispensing pump, and an outlet port. A main valve is mounted in the body between the inlet port and outlet port for selectively opening and closing the passageway to the flow of liquid, and a latch means is provided for selectively closing, and prohibiting the opening of, the main valve. The nozzle further comprises a first automatic shut-off means for selectively releasing the latch means so as to close, and prohibit the opening of, the main valve when supply pressure from the dispensing pump falls below a preselected value. In this regard, the body of the nozzle defines an actuator cavity which houses an actuator member, the actuator member being operatively associated with the latch means such that selective movement of the actuator member from a first position toward a second position releases the latch means. Biasing means are also provided for biasing the actuator member toward the second or unlatched position. The actuator cavity is transversely divided by a pressure diaphragm so as to define a pressure cavity which is placed in fluid communication with the passageway of the nozzle between the inlet port and the main valve by a pressure conduit. The pressure diaphragm is movably responsive to changes in pressure within the pressure cavity such that, when the pressure in the pressure cavity reaches a preselected value, the diaphragm engages the actuator member and moves the actuator member to the first or latched position, thereby allowing operation of the valve only when fluid pressure between the inlet port and main valve reaches a preselected value.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
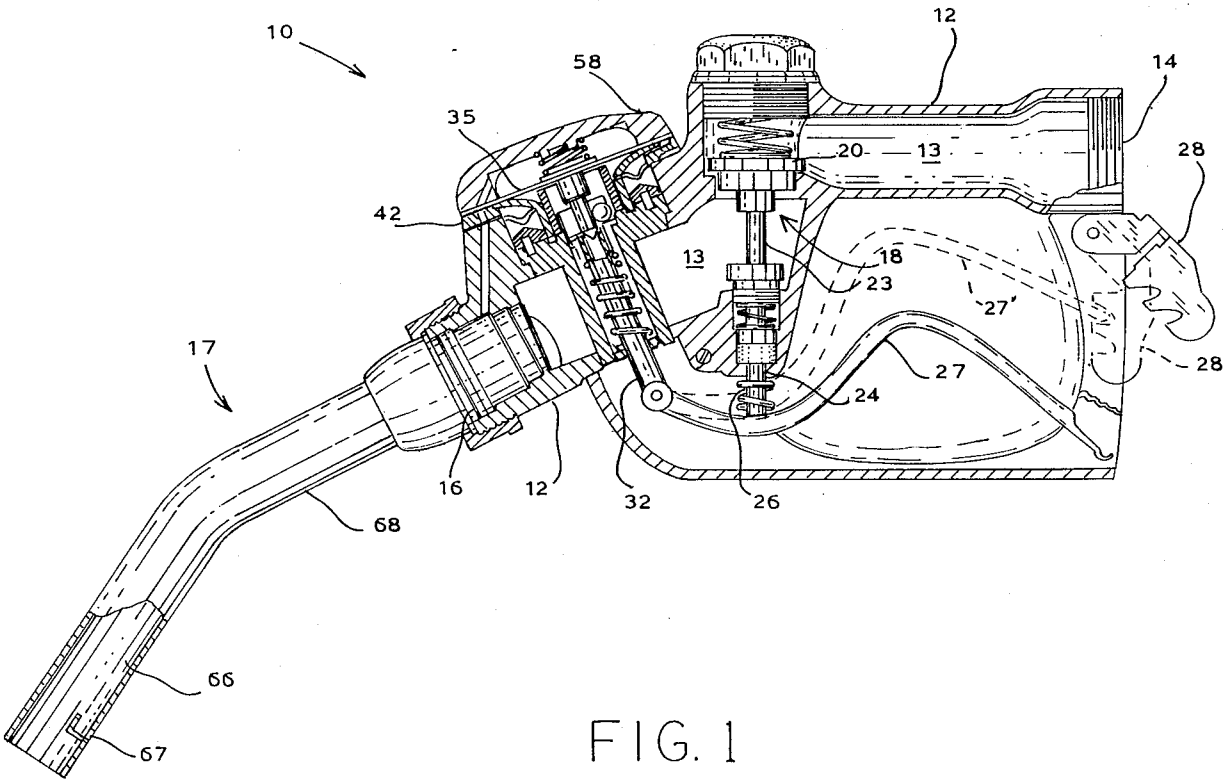
FIG. 1 illustrates a side elevation, partially in section, of the nozzle of the present invention.

A liquid dispensing nozzle incorporating various features of the present invention is illustrated generally at 10 in the figures. The nozzle 10 includes a body 12 defining an internal passageway 13. The internal passageway 13 is provided with an inlet port 14 through which liquid is received from a supply hose (not shown) and an outlet port 16 which communicates with a spout assembly 17 for directing liquid from the nozzle 10. The nozzle 10 also includes a main valve 18 mounted within the body 12 between the inlet port 14 and the outlet port 16 for selectively terminating the flow of liquid through the passageway 13.

More specifically, the main valve 18 comprises a valve member 20 which is biased into contact with a valve seat 21 defined by the body 12 with a valve spring 22 thereby terminating flow through the passageway 13. In order to facilitate the selective opening of the main valve 18, the valve member 20 carries a valve stem 23 which slidably exits the body 12 through the valve stem opening 24 such that the free end portion 26 of the stem 23 is positioned exterior to the body 12. A pivotally mounted operating lever 27 engages the free end portion 26 of the stem 23 and selective actuation of the lever 27, e.g., movement of the lever to the position referenced at 27' moves the valve member 20 against the bias of the spring 22 and out of contact with the valve seat 21 to allow liquid to flow through the passageway 13. It will also be noted that the nozzle 10 can be provided with a conventional hold-open means, such as the hold-open catch 28 illustrated in FIG. 1, for releasably engaging the lever 27 and holding it in an open position whereby the main valve 18 can be maintained in an open position while the nozzle is unattended.

The nozzle 10 is also provided with means for selectively disabling the lever 27 such that the lever 27 does not serve to open the main valve 18. Such means includes a plunger ball latch mechanism 29 mounted within the body 12 which selectively disables the lever 27 such that the lever 27 will not serve to open the main valve 18. The latch plunger 30 is slidably mounted in a plunger housing 31 within the body 12. The plunger 30 is provided with a lower end portion 32 which extends out of the housing 31 and pivotally engages the operating lever 27, and is provided with an upper end portion defining a latch pin receptor cup 33 for slidably receiving the latch pin 34. Further, the receptor cup 33 is provided with a plurality of radially disposed sidewall openings 36, preferably three such openings, for receiving the latch balls 37.

Figure 3:
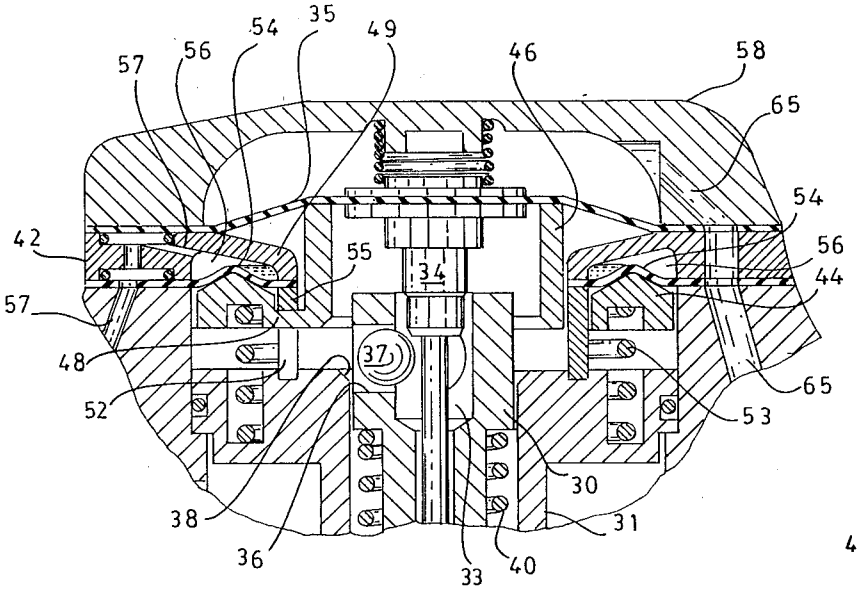
FIG. 3 illustrates a partial side elevation view, in section, of a nozzle of the present invention.

With respect to the operation of the mechanism 29, it will be appreciated that when the latch pin 34 is positioned within the receptor cup 33, at least a portion of the balls 37 extend outwardly beyond the plunger 30 such that the balls 37 engage the shoulder 38 defined by the housing 31, prohibiting downward movement of the plunger 30 within the housing 31. Thus, as the lever 27 is actuated, the position of the plunger 30 is fixed, providing the lever 27 with a fixed pivot point such that actuation of the lever opens the main valve 18. However, when the latch pin 34 is removed from the receptor cup 33 as illustrated in FIG. 3, the balls 37 are allowed to withdraw into the receptor cup 33 and no longer serve to prohibit the downward movement of the plunger 30. Thus, if the operating lever 27 is depressed, the plunger 30 moves downwardly and, the lever 27 being denied a fixed pivot point, will not serve to open the main valve 18. It will also be noted that a spring member 40 is provided in order to upwardly bias the plunger 30 to the locked, upwardly disposed position.

In order to facilitate the operation of the latch mechanism, the latch pin 34 is provided with mounting means which provides for axial movement of the pin 34 such that the pin 34 can be selectively inserted into, and removed from, the receptor cup 33. As will be discussed in detail below, in the preferred embodiment, such mounting means includes a flexible vacuum diaphragm 35 positioned above the receptor cup 33 which movably supports the pin 34 in coaxial alignment with the cup 33.

Operatively associated with the latch mechanism 29 is a first automatic shut-off means for closing the main valve 18 when supply pressure from the dispensing pump falls below a preselected value, and further automatic shut-off means for closing the main valve 18 when the fuel or liquid in the tank being filled reaches the level of the first automatic shut-off means, an actuator retainer 42 is mounted above the housing 31 for slidably journalling an actuator member which, in the preferred embodiment, defines a piston member 43. More specifically, the piston member 43 includes an annular actuator portion 44 coaxially supported on a piston hub 46 by a plurality of radial arms 48, the hub 46 defining an axial aperture 50 to accommodate the latch pin 34 and the upper portion of the plunger 30.

Figure 2:
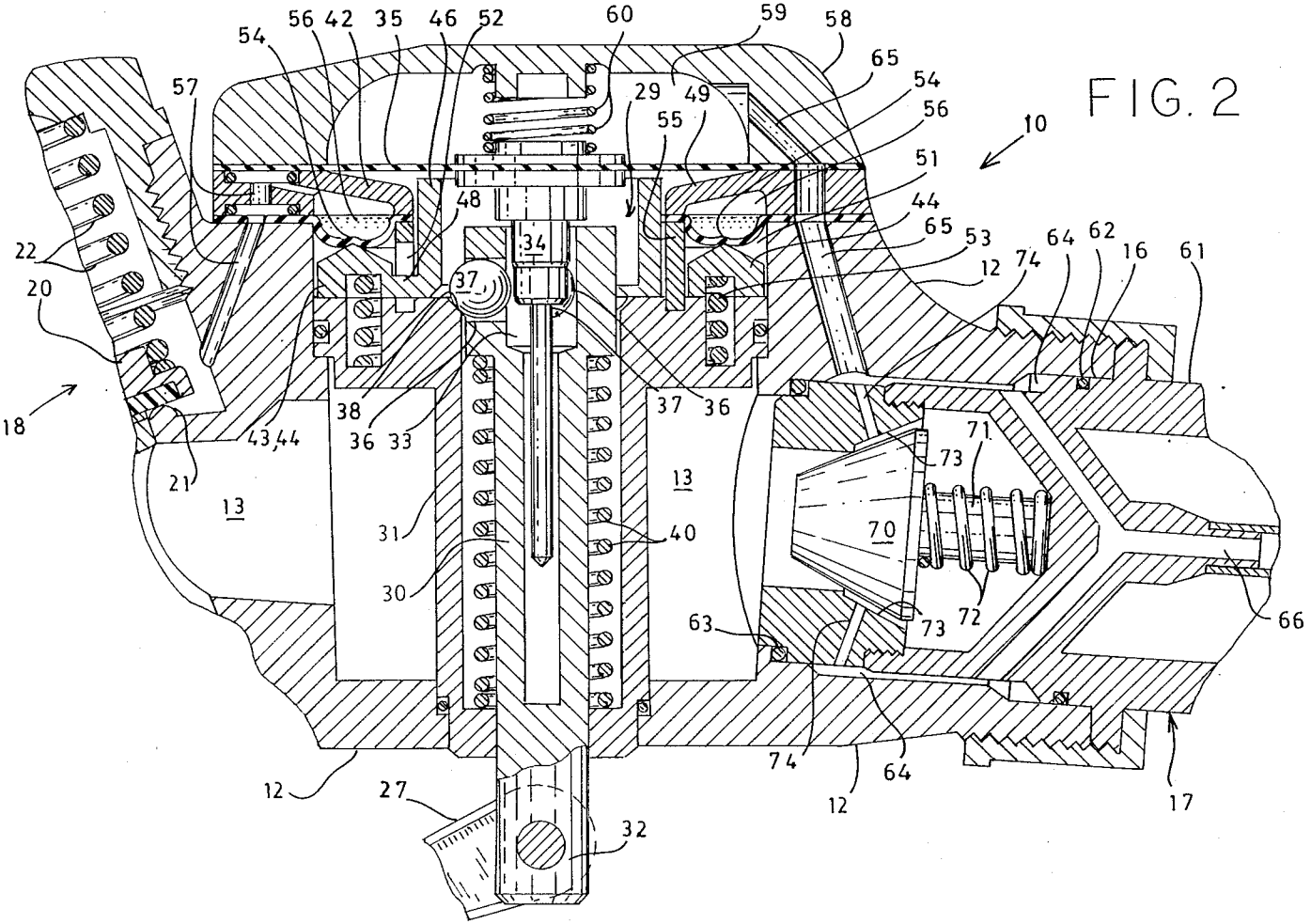
FIG. 2 illustrates a partial side elevation view, in section, of a nozzle of the present invention.
Figure 4:
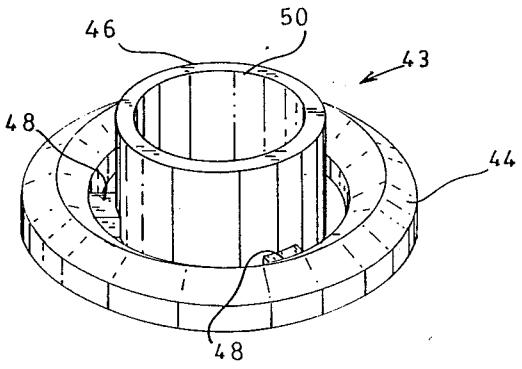
FIG. 4 illustrates a perspective view of a piston member of a nozzle of the present invention.

As is best illustrated in FIGS. 2 and 3, the retainer 42, the body 12 and the housing 31 cooperatively define an annular actuator cavity 51 which receives the actuator portion 44, the radial arms 48 of the piston member 43 being received through slots 52 provided in the retainer 42 such that the piston member 43 is axially movable within the actuator cavity from a lowered position to a raised position, with a spring 53 being provided to bias the piston portion to the raised position.

As is best illustrated in FIGS. 2 and 3, the actuator cavity 51 is transversely divided by a flexible pressure diaphragm 54 such that the annular pressure cavity is defined in the upper portion of the actuator cavity 51. In the preferred embodiment, the pressure diaphragm 54 is fabricated of a resilient material so as to be movably responsive to changes in the relative pressure on opposite sides of the diaphragm 54. This pressure cavity 56 is placed in fluid communication with the passageway 13, between the inlet port 14 and the main valve 18, with a pressure conduit 57. Resultantly, when fluid pressure within the passageway 13, between the inlet port 14 and the valve 18, exceeds a preselected value, the resulting pressure in the cavity 56 expands the diaphragm 54 forcing the actuator or piston member 43 downward against the bias of the spring 53. And, when fluid pressure within the passageway 13, between the inlet port 14 and the main valve 18, falls below such preselected value, the diaphragm 54 collapses against the bias of the spring 53, resulting in upward movement of the actuator or piston member 43. This upward movement of the piston member 43 brings the upper edge 59 of the piston hub 46 into contact with the vacuum diaphragm 35 thereby moving the diaphragm 35 upwardly so as to lift the latch pin 34 from the cup 33, disabling the lever 27. Accordingly, until pumping pressure in excess of a preselected value is supplied to the nozzle so as to move the piston member 43 to the lowered position, the nozzle 10 will not dispense liquid.

It will be recognized that, whereas upward movement of the piston member 43 is communicated to the latch pin 34 by contact between the hub 46, such movement can be communicated by other suitable means. For example, the piston member 43 can directly engage the latch pin 34, or engage the pin 34 through various linkages. The illustrated embodiment simply discloses the preferred means in view of the need to accommodate the operation of the further automatic shut-off means discussed below. Further, whereas in the preferred embodiment, the actuator member comprises the cylindrical piston member 43, the actuator member can define other configurations if desired.

Continuing with regard to the first automatic shut-off means, it will be noted that in the preferred embodiment, the actuator retainer 42 includes a pressure cap 49 and a ring 55, the ring 55 defining the slots 52. And, as illustrated, the pressure diaphragm 54 is secured proximate its outside perimeter between the retainer 42 and the body 12, the retainer being secured to the body 12 with suitable bolts (not shown), and secured proximate its inside perimeter between the retainer 42 and the ring 55. Thus, the pressure diaphragm is sealed by pressure against its mounting surfaces, and the diaphragm 54 can be quickly and easily replaced by removing the retainer 42, replacing the old diaphragm with a new one, and resecuring the retainer 42.

With regard to the further automatic shut-off means, the nozzle 10 includes a cap member 58 which, in cooperation with the vacuum diaphragm 35, defines a vacuum cavity 59 above the diaphragm 35. In the preferred embodiment, the cap member 58 is secured to the pressure cap 49 which is in turn secured to the body 12, with suitable bolts (not shown). As discussed above, the latch pin 34 is supported by the diaphragm 35, and extends downwardly therefrom. A spring member 60 is utilized to downwardly bias the latch pin 34 into the cup 33, thus, biasing the pin 34 toward a latched position.

The removal of the latch pin 34 from the receptor cup 33 in order to close the main valve 18 when the tank being filled is full is accomplished by the selective generation of a partial vacuum in the vacuum chamber cavity 59 such that the vacuum diaphragm 35 collapses inwardly with respect to the vacuum cavity 59, thus lifting the latch pin 34 from the cup 33. The vacuum necessary to effect such automatic closing of the main valve 18 is generated by the vacuum generating means in the spout assembly 17. Accordingly, fluid communications between the vacuum cavity 59 and the spout assembly 17 is provided by a vacuum conduit 65.

With regard to the vacuum generating means, the spout assembly 17 comprises a base member 61 which is secured to the body 12 at the outlet port 16. It will be noted that the base member 61 is provided with forward and rearward seal members 62 and 63, respectively, such that a circumferential chamber 64 is defined between the base member 61 and the body 12. Further, the spout assembly 17 is provided with a venting conduit 66 establishing fluid communication between the circumferential chamber 64 and a venting port 67, (See FIG. 1), the port 67 being located proximate the discharge or outboard end portion of the spout 68. The spout assembly also comprises a poppet valve 70 slidably mounted on a valve shaft 71, the poppet valve 70 being spring biased with a spring member 72 toward a poppet valve seat 73.

As is best illustrated in FIG. 2, the surface of the valve seat 73 is placed in fluid communication with the circumferential chamber 64 with the conduits 74. Therefore, it will be appreciated that when the main valve 18 is in an open position and liquid under pressure is forced through the outlet port 16, the poppet valve 70 is pushed forward allowing the fuel or liquid to escape around the valve 70 creating a venturi effect between the poppet valve 70 and the valve seat 73. As a result, a vacuum is generated, such vacuum being communicated to the circumferential chamber 64 via the conduits 74. Of course, as long as the venting conduit 66 remains open, the chamber 64 will remain vented to the ambient air pressure and no vacuum will be generated in the vacuum cavity 59. However, when the tank being filled becomes full to the extent that liquid covers the venting port 67, the venturi effect results in a partial vacuum being generated in the vacuum cavity 59 resulting in the lifting of the latch pin 34 so as to close the main valve 18.

With respect to the generation of the partial vacuum in vacuum cavity 59, it should be noted that in many conventional dispensing nozzles the poppet valve for generating the venturi effect is incorporated into the main valve of the nozzle. However, such alternate construction is totally compatible with the first automatic shut-off means of the nozzle 10, with only a change in the location of the vacuum conduit 65 being necessary.

From the above description, it will be appreciated that the nozzle 10 will not dispense liquid until there is dispensing pressure form the dispensing pump, and thus, the nozzle 10 provides an efficient and safe means for dispensing fuel at a pre-pay self-service filling station, without sacrificing the convenience of a hold-open catch. Further, the nozzle 10 is suitable for dispensing various liquids and is not limited to use only at pre-pay filling stations.

It will also be recognized that in the preferred embodiment, the first automatic shut-off means is removable such that the body 12 can be used when no first automatic shut-off means is desired. In this regard, the plunger housing 31, which is designed to accommodate the first automatic shut-off means, is releasably mounted in the body 12 such that it can be removed and replaced with a conventionally configured plunger housing. Alternatively, by releasably mounting the retainer 42, a spacing insert (not shown) can be substituted for the pressure cap 49 to insure proper positioning of the vacuum diaphragm 35 and the other components of the first automatic shut-off means removed if the first automatic shut-off means is not desired. Of course, it will be appreciated that this ability to selectively remove the first automatic shut-off means greatly reduces tooling and manufacturing cost where the manufacturer wishes to produce both a conventional nozzle without such means and a nozzle which requires pumping pressure to dispense. This also allows the components of the first automatic shut-off means to be offered as a separate, optional or add-on feature, to a conventionally functioning nozzle.

While a preferred embodiment has been shown and described, it will be understood that there is no intent to limit the invention to such disclosure, but, rather, it is intended to cover all modifications and alternate constructions falling within the spirit and scope of the invention as defined in the appended claims.

I claim:

1. A liquid dispensing nozzle for dispensing a liquid from a dispensing pump, said nozzle comprising:

a nozzle body provided with an internal passageway therethrough, said passageway defining an inlet port for being releasably connected in fluid communication to said dispensing pump, and an outlet port, said body further defining a main valve seat within said passageway, said body being provided with an actuator cavity and a pressure conduit for placing said actuator cavity in fluid communication with said passageway between said inlet port and main valve seat;

a main valve mounted within said body between said inlet port and said outlet port for selectively engaging said valve seat and opening and closing said passageway to the flow of said liquid;

latch means for selectively closing and prohibiting the opening of said main valve; and automatic shut-off means for selectively releasing said latch means so as to close and prohibit the opening of said main valve when supply pressure from said dispensing pump falls below a preselected value, said automatic shut-off means including an actuator member movably mounted in said actuator cavity and operatively associated with said latch means, whereby selective movement of said actuator member from a first position toward a second position releases said latch means, said actuator member being provided with biasing means for biasing said actuator member toward said second position, said automatic shut-off means further including a pressure diaphragm transversely dividing said actuator cavity so as to define a pressure cavity in fluid communication with said conduit, said pressure diaphragm being movably responsive to changes in pressure within said pressure cavity, said pressure diaphragm selectively engaging said actuator member such that preselected movement of said pressure diaphragm in response to pressure within said pressure cavity reaching said preselected value moves said actuator member to said first position against the bias of said biasing means.

2. The liquid dispensing nozzle of claim 1 wherein said actuator member defines a piston member including an annular piston portion for being received in said actuator cavity.

3. The liquid dispensing nozzle of claim 2 wherein said latch means includes a latch pin axially movable from a first position, whereby said latch means permits the selective opening and closing of said main valve, to a second position, whereby said latch means closes and prohibits the opening of said main valve, and further includes a further flexible diaphragm mounted within said body, said latch pin being secured to said further diaphragm, and wherein upon movement of said piston member toward said second position, said piston member movably engages said further diaphragm, thereby moving said latch pin to said 4. The liquid dispensing nozzle of claim 3 wherein said piston member defines a hub portion for engaging said further diaphragm.

5. The liquid dispensing nozzle of claim 4 wherein said piston member is disposed below said further diaphragm.

6. A liquid dispensing nozzle for dispensing a liquid from a dispensing pump, said nozzle comprising:

a nozzle body provided with an internal passageway therethrough, said passageway defining an inlet port for being releasably connected in fluid communication to said dispensing pump, and an outlet port, said body further defining a main valve seat within said passageway, said body being provided with an annular actuator cavity and a pressure conduit for placing said actuator cavity in fluid communication with said passageway between said inlet port and main valve seat;

a main valve mounted within said body between said inlet port and said outlet port for selectively engaging said valve seat and selectively opening and closing said passageway to the flow of said liquid;

latch means for selectively closing and prohibiting the opening of said main valve, said latch means including a latch pin mounted within said body on a flexible diaphragm so as to be axially movable from a first position, whereby said latch means permits the selective opening of said main valve, to a second position, whereby said latch means closes and prohibits the opening of said main valve;

automatic shut-off means for selectively releasing said latch means so as to close and prohibit the opening of said main valve when supply pressure from said dispensing pump falls below a preselected value, said automatic shut-off means including a piston member movably mounted in said actuator cavity and operatively associated with said latch means, said piston member being movable from a first position whereby said piston member is out of contact with said flexible diaphragm to a second position whereby said piston member movably engages said flexible diaphragm thereby moving said latch pin to said second position whereby said main valve is closed and prohibited from opening, said piston member being provided with biasing means for biasing said piston member toward said second position, said automatic shut-off means further including a pressure diaphragm transversely dividing said piston cavity so as to define a pressure cavity in fluid communication with said conduit, said pressure diaphragm being movably responsive to changes in pressure within said pressure cavity, said pressure diaphragm selectively engaging said piston member such that preselected movement of said pressure diaphragm in response to pressure within said pressure cavity reaching said preselected value moves said piston member to said first position against the bias of said biasing means;

a spout assembly secured to said outlet port of said body for selectively directing the flow of said liquid from said nozzle, said spout assembly defining a discharge end; and further automatic shut-off means for closing said main valve when said liquid reaches the discharge end of said spout assembly.

7. The liquid dispensing nozzle of claim 6 wherein said actuator cavity is disposed below said flexible diaphragm and circumscribes said latch pin, said piston member comprising a hub circumscribing said latch pin for selectively engaging said flexible diaphragm and an annular piston portion movably mounted in said actuator cavity, said piston portion being secured to said hub by a plurality of radial arms.

8. The liquid dispensing nozzle of claim 7 wherein said biasing means comprises a spring disposed within said actuator cavity below said piston portion for biasing said piston member toward said flexible diaphragm, and wherein said pressure cavity is disposed above said piston portion.

* * * * *